United States Patent [19]

Teass, Jr.

[11] 4,232,922

[45] Nov. 11, 1980

[54] SIGNAL POWER COUPLING TO ROTARY SHAFT

[76] Inventor: Horace A. Teass, Jr., 25 Mead Rd., Armonk, N.Y. 10705

[21] Appl. No.: 54,611

[22] Filed: Jul. 3, 1979

[51] Int. Cl.[3] ..... H01R 39/00

[52] U.S. Cl. ..... 339/5 R; 73/136 A; 339/8 A

[58] Field of Search ..... 339/12 R, 12 G, 5, 8; 73/136 A; 180/79.1; 184/1.5

[56] References Cited

U.S. PATENT DOCUMENTS

| | | | |
|---|---|---|---|
| 2,531,288 | 11/1950 | Moore | 184/1.5 X |
| 2,548,397 | 4/1951 | Schaevitz | 73/136 A |
| 3,732,487 | 5/1973 | Rozelle | 339/8 A X |
| 3,850,030 | 11/1974 | Adler | 73/136 A |
| 3,871,215 | 3/1975 | Pratt, Jr. et al. | 73/136 A |
| 3,961,526 | 6/1976 | Himmelstein | 73/136 A |

*Primary Examiner*—Mark Rosenbaum
*Assistant Examiner*—DeWalden W. Jones
*Attorney, Agent, or Firm*—Peck & Peck

[57] ABSTRACT

A system for coupling electrical power to a rotary shaft without mechanically contacting the shaft includes a stationary transformer primary core positioned adjacent but spaced from the shaft so that the shaft forms part of a complete magnetic flex path for the core, and an insulated conductor mounted directly upon the shaft in the form of a winding which is positioned to be inductively associated with the transformer primary.

3 Claims, 2 Drawing Figures

SIGNAL POWER COUPLING TO ROTARY SHAFT

BACKGROUND OF THE INVENTION

The present invention relates generally to electrically coupling systems and, more particularly, to an electrical system for coupling electrical power to a load mounted on a rotating shaft without mechanically contacting the shaft.

Inherent in the measurement of vibration, stress, torque and shaft horsepower associated with rotary shafts is the problem of introducing or coupling electrical power to the rotating shaft. In applications which will allow mechanical coupling or contact with the shaft, brush contacts are suitable. In applications where no mechanical coupling is allowed, rotary transformers have been used. However, prior art rotary transformers are relatively expensive and add size and weight to the rotating system. Typical prior art rotary transformers are disclosed in U.S. Pat. Nos. 2,531,288 (MacGeorge), 2,548,397 (Schaevitz), 3,850,030 (Adler) and 3,961,526 (Himmelstein).

OBJECTS AND SUMMARY OF THE INVENTION

Accordingly, it is an object of the present invention to provide a system for coupling electrical power to a load mounted on a rotating shaft without mechanically contacting the shaft.

It is a further object of the present invention to provide a coupling system of the type indicated which is more economical than the prior art systems having rotary transformers.

In accordance with the foregoing objects, the present invention is summarized in that apparatus for coupling electrical power to a load mounted on a rotary shaft without mechanically coupling to the shaft includes a stationary transformer primary core positioned adjacent but spaced from the shaft so that the shaft will provide a magnetic flex path to complete the core's magnetic circuit; and an insulated conductor is wrapped around the shaft so that the conductor contacts the shaft and forms a transformer secondary winding which is positioned to be conductively associated with the transformer primary.

DESCRIPTION OF THE PREFERRED EMBODIMENT

Figure 1:
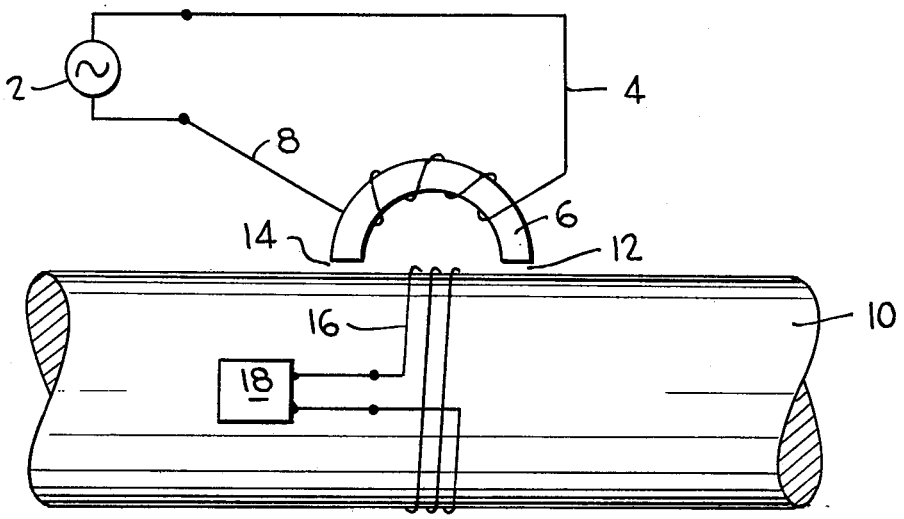
FIG. 1 is a perspective view partially cut away of one embodiment of the invention.
Figure 2:
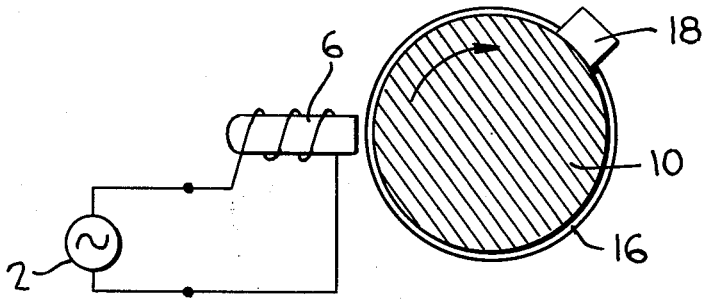
FIG. 2 is an end view of the invention as illustrated in FIG. 1.

Referring now to FIGS. 1 and 2 for a description of the preferred embodiment of the invention, a suitable AC signal source 2 is connected to insulated conductor 4 which is wrapped around a transformer core 6 to form a winding thereon and returned to source 2 as indicated at 8. The apparatus described thus far forms a transformer primary.

The transformer primary which is stationary is positioned adjacent but spaced from a rotary steel shaft 10 as indicated by air gaps 12 and 14. When source 2 energizes primary winding 4, a complete magnetic circuit or path is established including core 6, air gap 12, steel shaft 10 and air gap 14 back to core 6. Thus the system uses the rotary shaft itself as a part of the magnetic coupling system.

An insulated conductor 16 is supported by the shaft 10 so that it rotates with shaft 10 relative to core 6. The conductor 16 is wrapped around shaft 10 to form a winding of several turns thereon. Conductor winding 16 is positioned to be inductively associated with the transformer primary winding 4, that is, to be continuously in the magnetic flex path of primary core winding 6. Conductor winding 16 functions as a transformer secondary. The ends of conductor 16 are connected across a load 18 so that electrical power induced in conductor winding 16 with supply load 18.

In accordance with the invention, the conductor winding 16 is inductively associated with the transformer primary winding 4. Current flowing in primary winding 4 induces a current in secondary winding 16 which is supplied to the load 18.

Obviously, many modifications and variations are possible in the light of the above teaching. It is, therefore, to be understood that within the scope of the appended claims the invention may be practiced otherwise than as specifically described.

What is claimed is:

1. A system for coupling electrical power to a load mounted on a rotary shaft without mechanically contacting the shaft comprising:

a rotary shaft;

a transformer primary having a core positioned adjacent but spaced apart from said shaft by air gaps whereby said core, said shaft and said air gaps form a complete magnetic circuit; and an insulated conductor abutting and wrapped around said shaft to form a winding thereon whereby said winding rotates with said shaft and is positioned to be inductively associated with said transformer primary.

2. A coupling system in accordance with claim 1, wherein a signal source supplies electrical power to said transformer primary.

3. A coupling system in accordance with claim 1, wherein a load is connected to said insulated conductor to receive electrical power therefrom.

* * * * *